US011725655B2

(12) United States Patent
Sakai et al.

(10) Patent No.: US 11,725,655 B2
(45) Date of Patent: Aug. 15, 2023

(54) OIL PUMP

(71) Applicant: TOYODA GOSEI CO., LTD., Kiyosu (JP)

(72) Inventors: Shinya Sakai, Kiyosu (JP); Wataru Matsumoto, Kiyosu (JP)

(73) Assignee: TOYODA GOSEI CO., LTD., Aichi-pref. (JP)

( * ) Notice: Subject to any disclaimer, the term of this patent is extended or adjusted under 35 U.S.C. 154(b) by 272 days.

(21) Appl. No.: 16/815,140

(22) Filed: Mar. 11, 2020

(65) Prior Publication Data

US 2020/0309122 A1 Oct. 1, 2020

(30) Foreign Application Priority Data

Mar. 26, 2019 (JP) ..... 2019-059504

(51) Int. Cl.
*F04C 15/06* (2006.01)
*F04C 2/10* (2006.01)

(52) U.S. Cl.
CPC ..... *F04C 15/06* (2013.01); *F04C 2/10* (2013.01); *F04C 2210/206* (2013.01); *F04C 2240/30* (2013.01); *F05B 2280/6015* (2013.01)

(58) Field of Classification Search
CPC .... F04B 2280/6015; F04C 15/06; F04C 2/10; F04C 2210/206; F04C 2240/30
See application file for complete search history.

(56) References Cited

U.S. PATENT DOCUMENTS 9,453,508 B2 9/2016 Suzuki et al.
9,810,215 B2 11/2017 Ishii et al.
2010/0130327 A1* 5/2010 Morgan, Jr. ..... F04C 2/102 417/356
2014/0241917 A1 8/2014 Suzuki et al.
(Continued)

FOREIGN PATENT DOCUMENTS

JP 2006267168 A * 10/2006
JP 2008-267168 A 11/2008
JP 2014-51964 A 3/2014
(Continued)

OTHER PUBLICATIONS

Office Action dated Sep. 2, 2021, issued in corresponding CN Patent Application No. 202010111164.7 (and English Machine Translation).
(Continued)

*Primary Examiner* — Connor J Tremarche
(74) *Attorney, Agent, or Firm* — Posz Law Group, PLC

(57) ABSTRACT

An oil pump includes: a housing case made of a metal and having a rotor housing portion in which a rotor is rotatably housed, and a discharge hole through which oil within the rotor housing portion is introduced to the outside of the rotor housing portion by rotation of the rotor; and a housing made of a resin and having a case holding portion in which the rotor housing portion is held, and a discharge groove portion provided on a bottom portion of the case holding portion. The housing case has a fitting groove portion that is provided on a bottom portion of the rotor housing portion and that is fitted to the discharge groove portion so as to cover the discharge groove portion. The discharge hole is formed in the fitting groove portion.

2 Claims, 9 Drawing Sheets

(56) References Cited

U.S. PATENT DOCUMENTS

2015/0204325 A1 7/2015 Ishii et al.

FOREIGN PATENT DOCUMENTS

| | | | | |
|---|---|---|---|---|
| JP | 2014-196733 | A | | 10/2014 |
| JP | 2017-066976 | A | | 4/2017 |
| JP | 2017066976 | A | * | 4/2017 |

OTHER PUBLICATIONS

Notice of Reasons for Refusal dated Mar. 22, 2022 issued in connection with JP application No. 2019-059504 (and Machine Translation).

* cited by examiner

OIL PUMP

TECHNICAL FIELD

The present invention relates to an oil pump.

BACKGROUND ART

Hitherto, a trochoid type oil pump has been known (for example, JP2014-51964(A) and JP2017-66976(A)). The oil pump includes a rotor and a housing. The rotor has an inner rotor that is fixed to a drive shaft and that has external teeth, and an outer rotor that has internal teeth that mesh with the external teeth of the inner rotor. The rotor sucks oil from the suction side and discharges the oil to the discharge side, by the inner rotor rotating in a state where the inner rotor is eccentric to the outer rotor. The housing has a housing body member and a cover member. The housing body member has a recess in which the inner rotor and the outer rotor are housed. The cover member is disposed in an axial direction with respect to the housing body member and closes the recess of the housing body member.

In the oil pump disclosed in JP2014-51964(A), the inner rotor, the outer rotor, and the cover are each formed from a metal. In addition, at least a part of the housing is formed from an injection-molded resin. According to the structure of the oil pump, size reduction is achieved as compared to a structure in which the entire housing is formed from a metal.

The oil pump disclosed in JP2017-66976(A) includes a metallic housing case having a rotor housing portion in which the inner rotor and the outer rotor are housed. The housing case is insert-molded in a housing body member made of a resin and is disposed in a recess of the housing body member. The housing portion of the housing case and the recess of the housing body member are closed by a metallic cover member.

SUMMARY OF INVENTION

Technical Problem

Meanwhile, in an oil pump, the oil pressure at the discharge side is high. Thus, in a structure in which a housing case made of a metal and a housing made of a resin are used as in the oil pump disclosed in JP2017-66976(A), if the housing made of a resin (particularly, a groove portion around a discharge hole) has a portion to be exposed to high oil pressure, the high oil pressure acts on the portion, so that the housing made of a resin is easily deformed.

The present invention has been made in view of such a problem, and an object of the present invention is to provide an oil pump that avoids a situation in which high pressure acts on a housing made of a resin, thereby inhibiting deformation of the housing.

Solution to Problem

An aspect of the present invention is directed to an oil pump comprising: a housing case made of a metal and having a rotor housing portion in which a rotor is rotatably housed, and a discharge hole through which oil within the rotor housing portion is introduced to the outside of the rotor housing portion by rotation of the rotor; and a housing made of a resin and having a case holding portion in which the rotor housing portion is held, and a discharge groove portion provided on a bottom portion of the case holding portion, wherein the housing case has a fitting groove portion that is provided on a bottom portion of the rotor housing portion and that is fitted to the discharge groove portion so as to cover the discharge groove portion, and the discharge hole is formed in the fitting groove portion.

In this structure, the housing case made of a metal has a fitting groove portion that is fitted to the discharge groove portion of the housing made of a resin so as to cover the discharge groove portion, and a discharge hole for oil discharge is formed in the fitting groove portion. Thus, a situation in which the oil pressure of oil that has flowed from the interior of the housing case into the fitting groove portion acts on the discharge groove portion of the housing is avoided, so that the housing made of a resin is inhibited from deforming when oil is pressure-fed.

DESCRIPTION OF EMBODIMENTS

Specific embodiments of the oil pump according to the present invention will be described with reference to FIG. 1 to FIG. 16.

Figure 1:
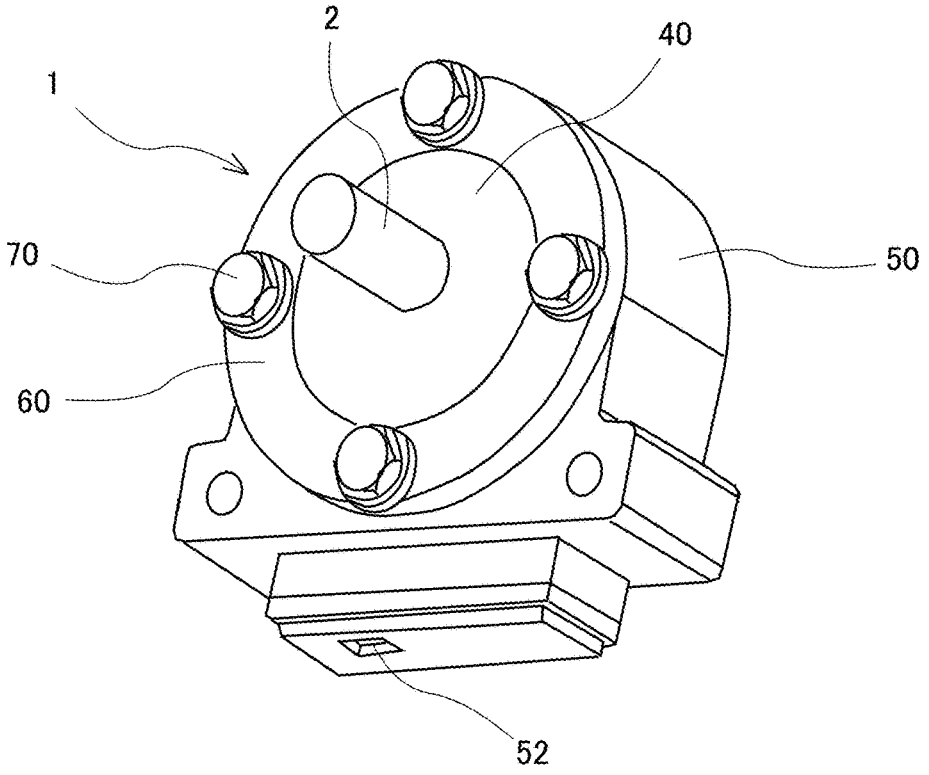
FIG. 1 is a perspective view of an oil pump according to an embodiment as seen from the front side.
Figure 2:
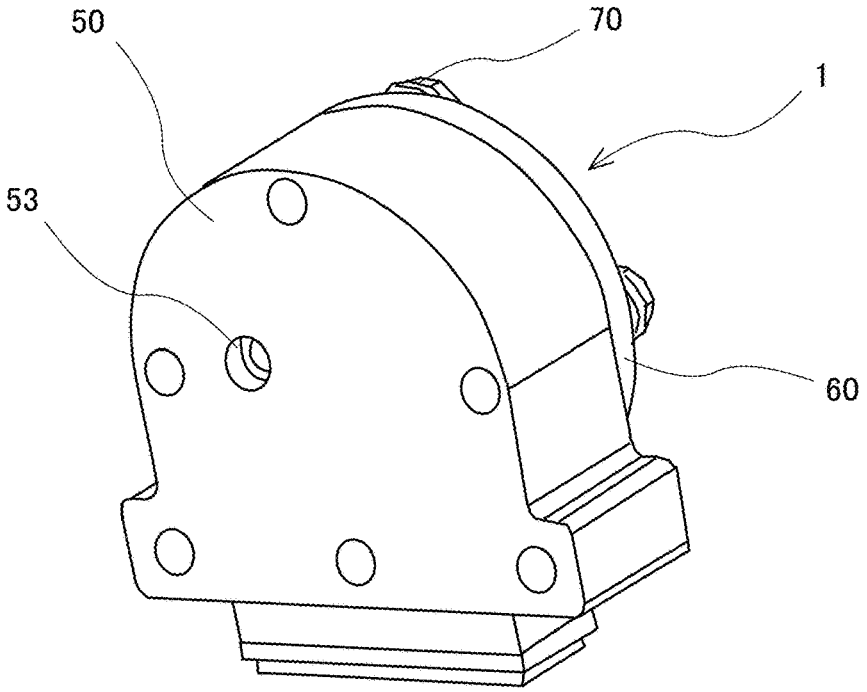
FIG. 2 is a perspective view of the oil pump according to the embodiment as seen from the back side.

An oil pump 1 according to an embodiment is a trochoid type internal gear pump that pressure-feeds, to a discharge port, oil sucked from a suction port. The oil pump 1 is mounted, for example, on a vehicle or the like. The oil pump 1 is formed in a block shape as shown in FIG. 1 and FIG. 2.

Figure 3:
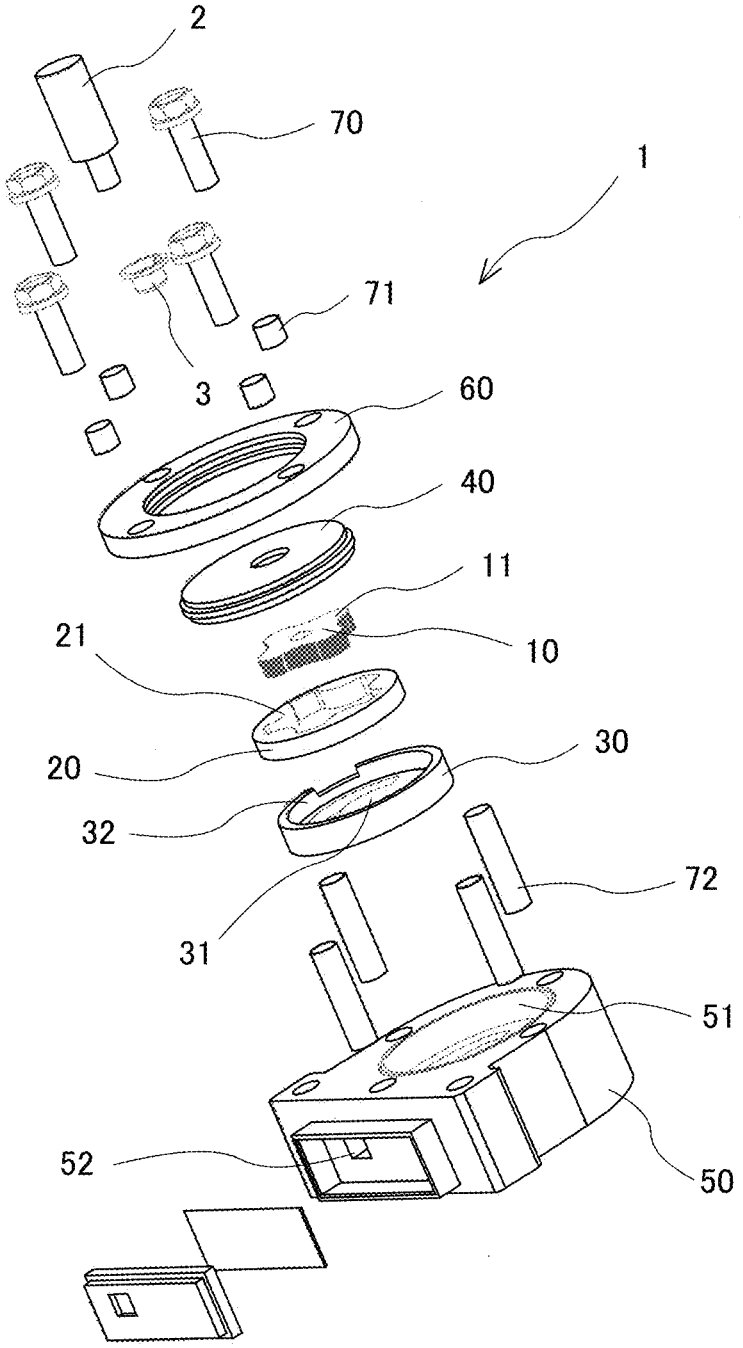
FIG. 3 is an exploded view of the oil pump according to the embodiment.

As shown in FIG. 3, the oil pump 1 includes an inner rotor 10 and an outer rotor 20. The inner rotor 10 and the outer rotor 20 form a trochoid. Each of the inner rotor 10 and the outer rotor 20 is formed from a sintered metal (for example, an iron-based metal, a copper-iron-based metal, a copper-based metal, a stainless-based metal, etc.).

The inner rotor 10 is a disc-shaped or columnar member. The inner rotor 10 is fixed to a drive shaft 2. The drive shaft 2 is rotatably supported by a later-described second case member 40 via a bearing 3. The inner rotor 10 rotates integrally with rotation of the drive shaft 2. The inner rotor 10 has external teeth 11. The external teeth 11 are provided on the outer circumferential surface of the inner rotor 10 at equiangular intervals. The number of the external teeth 11 of the inner rotor 10 is a predetermined number (for example, four).

The outer rotor 20 is an annular or cylindrical member. The outer rotor 20 has internal teeth 21. The internal teeth 21 mesh with the external teeth 11 of the inner rotor 10. The internal teeth 21 are provided on the inner circumferential surface of the outer rotor 20 at equiangular intervals. The number of the internal teeth 21 of the outer rotor 20 is a predetermined number (for example, five) that is larger than the number of the external teeth 11 of the inner rotor 10 by a predetermined number (for example, one). The inner rotor 10 is housed within the outer rotor 20 so as to be rotatable in a state where the inner rotor 10 is eccentric to the outer rotor 20 while the external teeth 11 mesh with the internal teeth 21 of the outer rotor 20.

Figure 4:
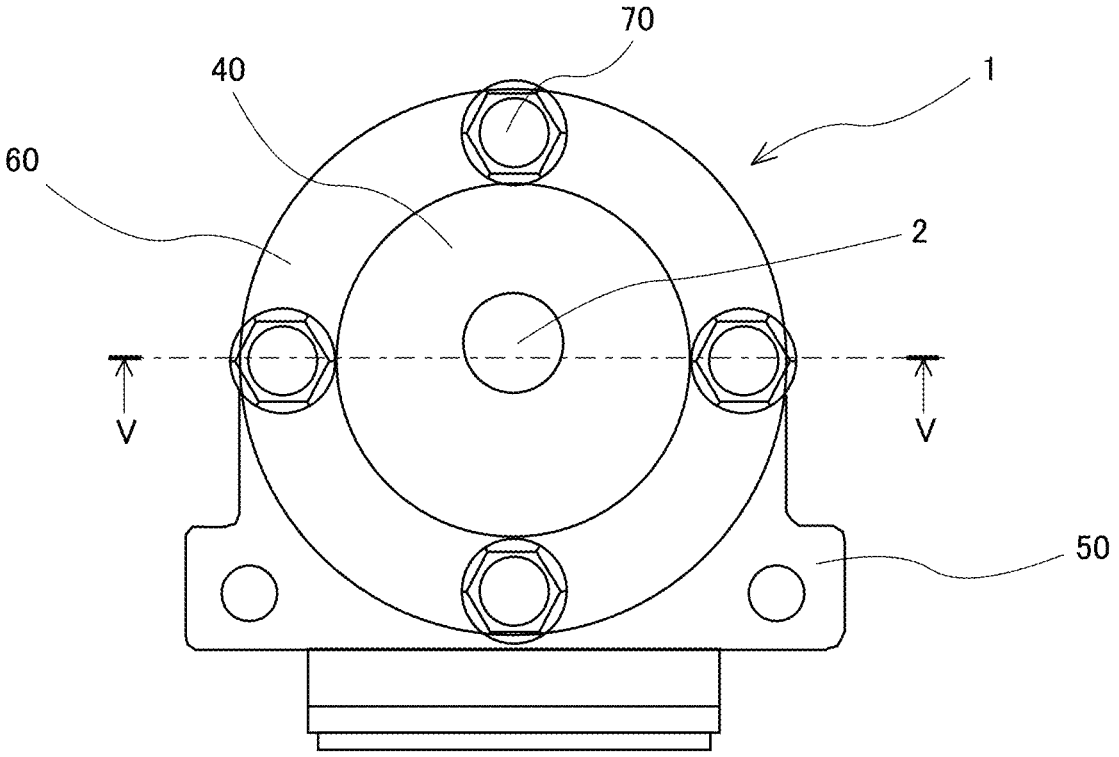
FIG. 4 is a front view of the oil pump according to the embodiment.
Figure 5:
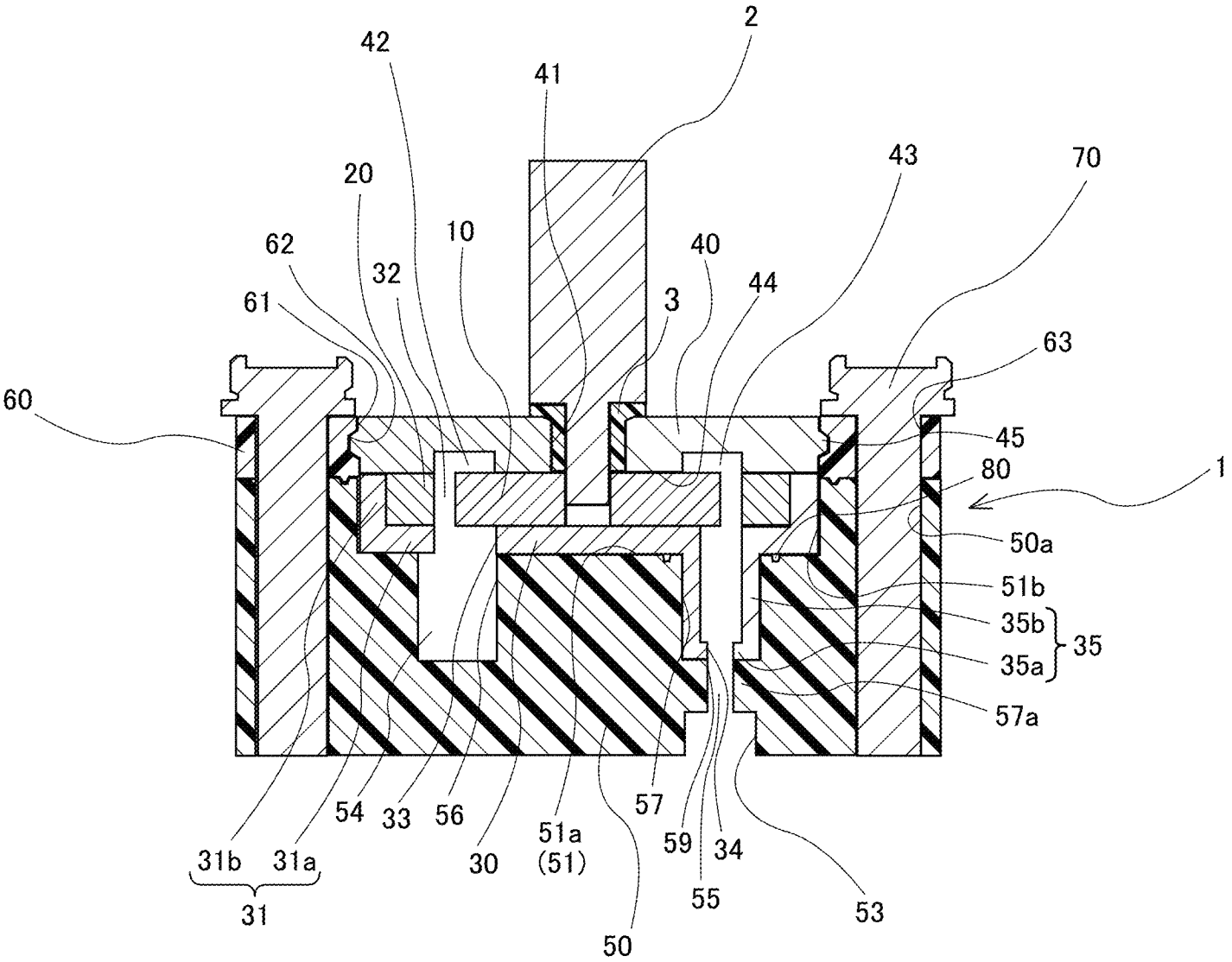
FIG. 5 is a cross-sectional view of the oil pump according to the embodiment taken along a line V-V shown in FIG. 4.
Figure 6:
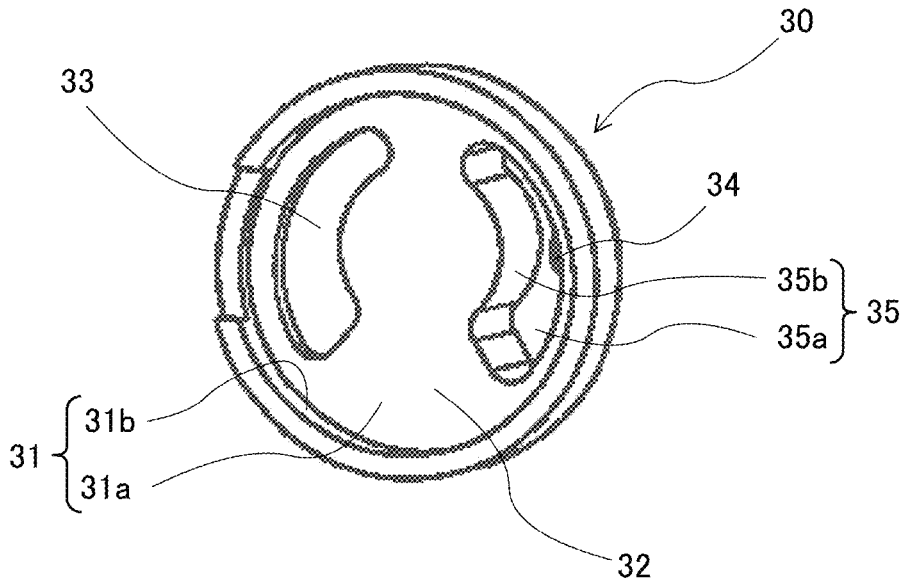
FIG. 6 is a perspective view of a first case member of a housing case included in the oil pump according to the embodiment, as seen from a housing space side.
Figure 7:
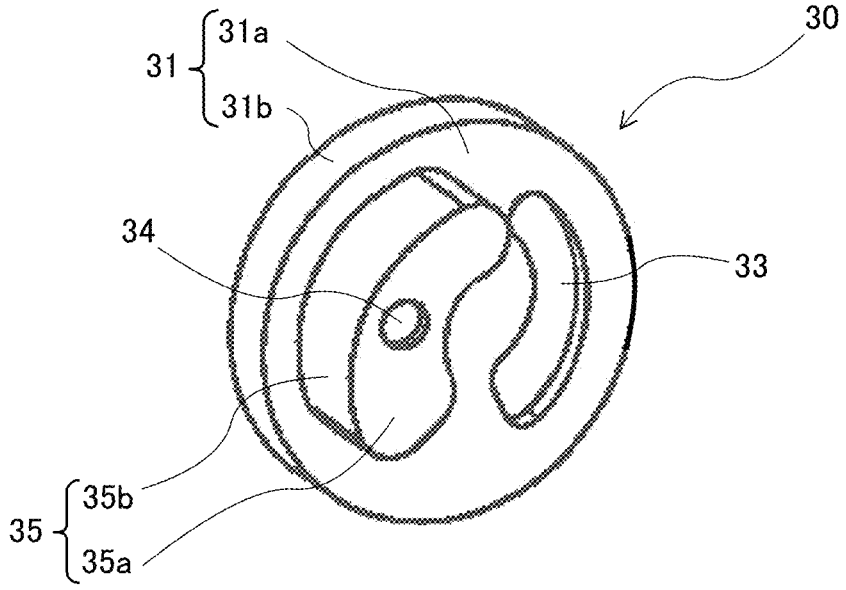
FIG. 7 is a perspective view of the first case member of the housing case included in the oil pump according to the embodiment, as seen from an anti-housing space side.
Figure 8:
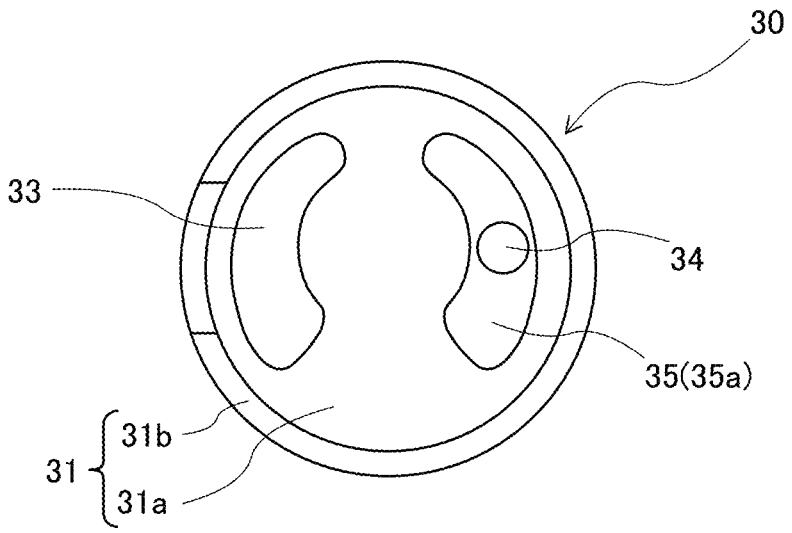
FIG. 8 is a front view of the first case member of the housing case included in the oil pump according to the embodiment, as seen from the housing space side.
Figure 9:
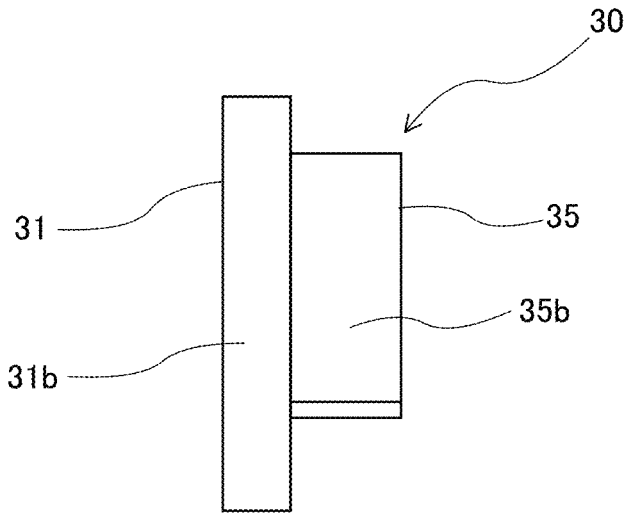
FIG. 9 is a side view of the first case member of the housing case included in the oil pump according to the embodiment.

As shown in FIG. 3, FIG. 4, and FIG. 5, the oil pump 1 includes a first case member 30 and the second case member 40. The first case member 30 and the second case member 40 form a housing case in which the inner rotor 10 is housed so as to be rotatable relative to the outer rotor 20. Each of the first case member 30 and the second case member 40 is formed from a metal such as iron or aluminum. Each of the first case member 30 and the second case member 40 is a molded article formed by pressing, heading, or die casting, or a workpiece further subjected to cutting or polishing.

The first case member 30 is a housing body portion in which the inner rotor 10 and the outer rotor 20 are housed. As shown in FIG. 5, FIG. 6, FIG. 7, FIG. 8, and FIG. 9, the first case member 30 has a rotor housing portion 31. The rotor housing portion 31 forms a housing space 32 therein. The rotor housing portion 31 is formed in a tubular shape (specifically, a cylindrical shape) as a whole. The rotor housing portion 31 has a disc-shaped bottom portion 31*a*, and a tubular side portion 31*b* that projects from the outer edge of the bottom portion 31*a* in the axial direction.

The inner rotor 10 and the outer rotor 20 are housed in the housing space 32 of the rotor housing portion 31. The rotor housing portion 31 is open at the side axially opposite to the bottom portion 31*a* side. The inner rotor 10 and the outer rotor 20 are inserted into the housing space 32 from the opening side of the rotor housing portion 31 when assembling the inner rotor 10 and the outer rotor 20 to the rotor housing portion 31. The outer rotor 20 is, for example, press-fitted and fixed to the rotor housing portion 31. The inner rotor 10 is rotatable relative to the outer rotor 20 in the housing space 32.

The first case member 30 has an introduction hole 33 and a discharge hole 34. The introduction hole 33 is a hole through which external oil is introduced to the housing space 32 of the rotor housing portion 31 by rotation of the inner rotor 10 relative to the outer rotor 20. The introduction hole 33 is formed in the bottom portion 31*a* of the rotor housing portion 31. The introduction hole 33 is a through hole that is formed in the bottom portion 31*a* so as to extend in an arc shape in the circumferential direction and that faces in the axial direction. The discharge hole 34 is a hole through which oil within the housing space 32 is introduced to the outside of the housing space 32 by rotation of the inner rotor 10 relative to the outer rotor 20.

The first case member 30 has a fitting groove portion 35. The fitting groove portion 35 is provided on the bottom portion 31*a* of the rotor housing portion 31. The fitting groove portion 35 extends in an arc shape in the circumferential direction on the bottom portion 31*a*. The fitting groove portion 35 has a depth in the axial direction opposite to the axial direction in which the side portion 31*b* projects from the surface of the bottom portion 31*a*. The fitting groove portion 35 has a bottom portion 35*a*, and a tubular side portion 35*b* that projects from the outer edge of the bottom portion 35*a* in the axial direction.

The fitting groove portion 35 is provided at a portion, of the bottom portion 31*a* of the rotor housing portion 31, different from a portion in which the introduction hole 33 is formed. That is, the introduction hole 33 and the fitting groove portion 35 are not directly connected to each other on the bottom portion 31*a* of the first case member 30. The fitting groove portion 35 is a groove that is fitted to a discharge groove portion 57 of a housing body member 50 as described later. The discharge hole 34 is formed in the bottom portion 35*a* of the fitting groove portion 35. The discharge hole 34 is a through hole that is formed in a circular shape in the bottom portion 35*a* and that faces in the axial direction.

The second case member 40 is formed in a disc shape or a cylindrical shape so as to have a predetermined thickness in the axial direction. The second case member 40 is a member that closes the housing space 32 of the rotor housing portion 31 of the first case member 30. The second case member 40 may be formed from a thermosetting resin such as phenol resin, instead of being formed from a metal, unlike the first case member 30, and may be a workpiece subjected to cutting.

Figure 12:
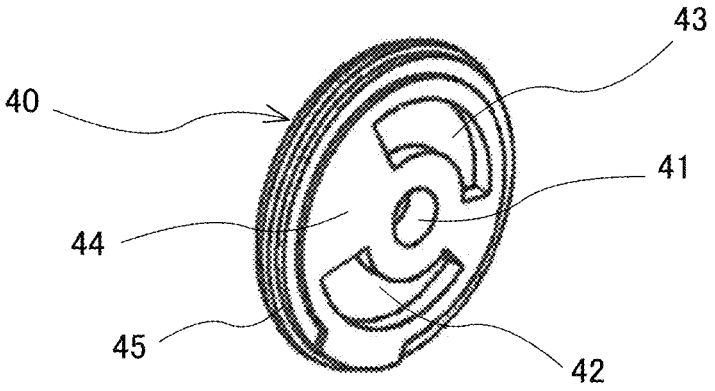
FIG. 12 is a perspective view of a second case member of the housing case included in the oil pump according to the embodiment, as seen from the housing space side.

The second case member 40 is disposed so as to be adjacent to the first case member 30 in the axial direction. The second case member 40 is brought into contact with the first case member 30 in the axial direction and positioned in the radial direction and the circumferential direction. As shown in FIG. 5 and FIG. 12, a through hole 41 is provided in the second case member 40 so as to penetrate the second case member 40 in the axial direction. An end portion of the drive shaft 2 is inserted into the through hole 41. The drive shaft 2 is rotatably supported by the second case member 40 via the bearing 3 disposed in the through hole 41.

The second case member 40 has two communication grooves 42 and 43 that communicate with the housing space 32 of the first case member 30. The communication grooves 42 and 43 are provided on an axial end surface 44, of the second case member 40, which faces the bottom portion 31*a* of the first case member 30. The communication groove 42 is located at a position opposing the introduction hole 33 of the first case member 30 in the axial direction. The communication groove 43 is located at a position opposing the fitting groove portion 35 of the first case member 30 in the axial direction. The communication groove 42 and the communication groove 43 are not directly connected to each other on the axial end surface 44 of the second case member 40.

As shown in FIG. 1, FIG. 2, and FIG. 3, the oil pump 1 includes the housing body member 50 and a cover member 60. The housing body member 50 and the cover member 60 form a housing in which not only the rotor, which is formed by the inner rotor 10 and the outer rotor 20, but also the housing case, which is formed by the first case member 30 and the second case member 40 and in which the rotor is housed, is held.

Each of the housing body member 50 and the cover member 60 is formed from a resin (particularly, a thermoplastic resin). Each of the resins for forming the housing body member 50 and the cover member 60 preferably has excellent creep resistance, load resistance, wear resistance, etc., and is, for example, a polyphenylene sulfide (PPS) resin, a thermoplastic polyimide resin, or the like. The material of the housing body member 50 and the material of the cover member 60 may be the same. The housing body member 50 and the cover member 60 are formed by injection molding or the like.

Figure 10:
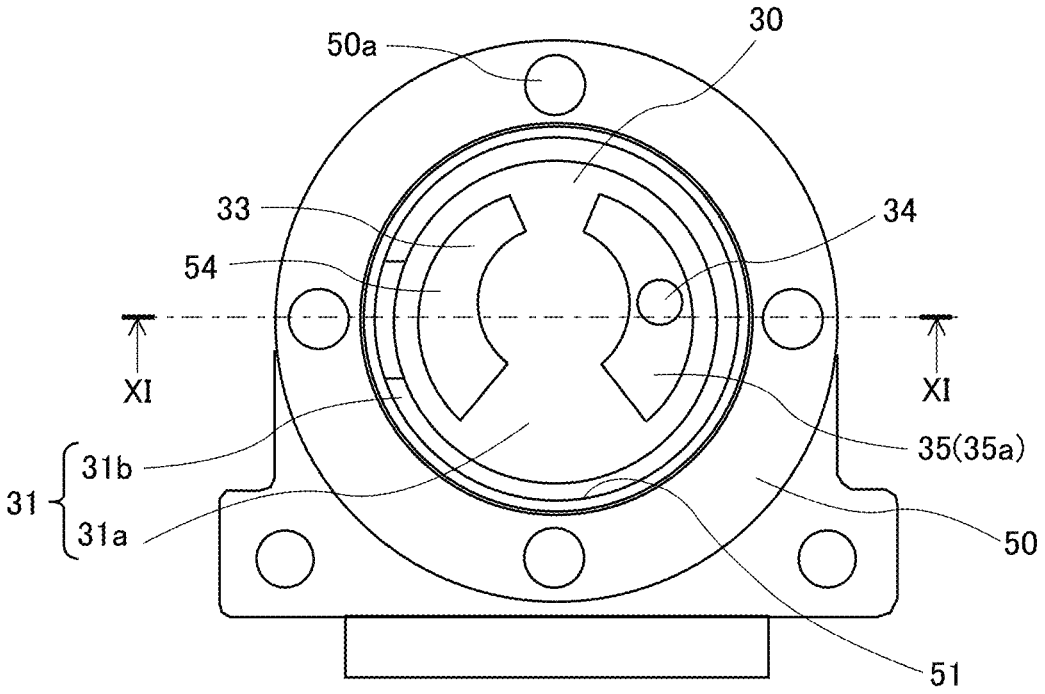
FIG. 10 is a front view of an assembly obtained by assembling the first case member to a housing body member included in the oil pump according to the embodiment, as seen from the housing space side.
Figure 11:
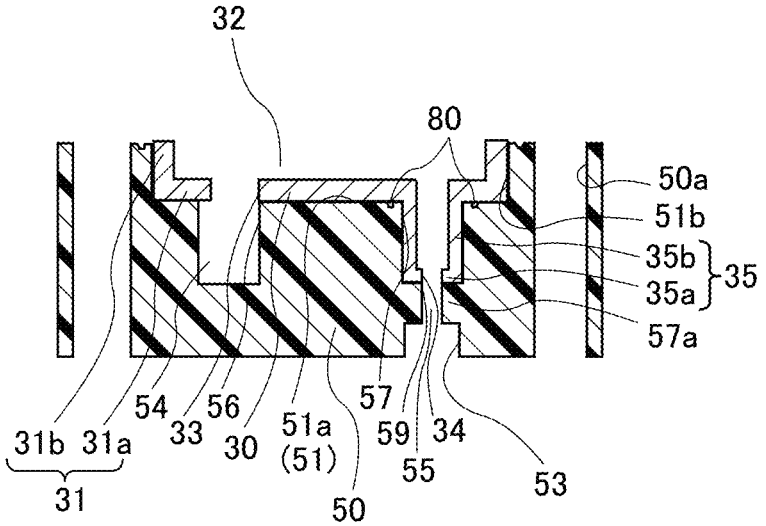
FIG. 11 is a cross-sectional view of the assembly obtained by assembling the first case member to the housing body member of the embodiment, taken along a line XI-XI shown in FIG. 10.

The housing body member 50 is formed in a block shape. As shown in FIG. 10 and FIG. 11, the housing body member 50 has a case holding portion 51. The case holding portion 51 is a recessed groove portion in which the first case member 30 is housed and held. The case holding portion 51 is formed in a shape corresponding to the outer shape of the first case member 30. The case holding portion 51 has a disc-shaped bottom portion 51*a*, and a tubular side portion 51*b* that projects from the outer edge of the bottom portion 51*a* in the axial direction. The first case member 30 is housed and held within the case holding portion 51 such that: the outer surface of the side portion 31*b* is in contact with the inner surface of the side portion 51*b* of the case holding portion 51; and the outer surface of the bottom portion 31*a* is in contact with the bottom surface of the bottom portion 51*a* of the case holding portion 51.

The housing body member 50 has a suction port 52 and a discharge port 53. The suction port 52 is an inlet through which oil is sucked from the outside into the oil pump 1. The suction port 52 is formed in the bottom surface (the lower surface in FIG. 1 and FIG. 2) of the housing body member 50. The discharge port 53 is an outlet through which oil is discharged from the oil pump 1 to the outside. The discharge port 53 is formed in the back surface (the surface at the near side in FIG. 2) of the housing body member 50.

The housing body member 50 has a suction passage 54 and a discharge passage 55. The suction passage 54 is connected at one end thereof to the suction port 52, and is connected at another end thereof to the introduction hole 33 of the first case member 30. The suction passage 54 is a passage through which oil sucked from the suction port 52 is introduced to the housing space 32 of the first case member 30. The discharge passage 55 is connected at one end thereof to the discharge hole 34 of the first case member 30, and is connected at another end thereof to the discharge port 53. The discharge passage 55 is a passage through which oil within the housing space 32 is introduced to the discharge port 53.

The housing body member 50 has a suction groove portion 56 and the discharge groove portion 57. The suction groove portion 56 and the discharge groove portion 57 are provided on the bottom portion 51*a* of the case holding portion 51. Each of the suction groove portion 56 and the discharge groove portion 57 is an oil reservoir adjacent to the housing space 32. Each of the suction groove portion 56 and the discharge groove portion 57 extends in an arc shape in the circumferential direction on the bottom portion 51*a*. The suction groove portion 56 and the discharge groove portion 57 are provided on portions, of the bottom portion 51*a* of the case holding portion 51, different from each other. That is, the suction groove portion 56 and the discharge groove portion 57 are not directly connected to each other on the bottom portion 51*a* of the case holding portion 51.

The suction groove portion 56 is located between the suction port 52 and the housing space 32. A communication port (not shown) is provided in a bottom portion or a side portion of the suction groove portion 56. The communication port is a port through which oil sucked from the suction port 52 is introduced to the suction groove portion 56. The suction groove portion 56 forms a part of the suction passage 54 that connects the suction port 52 to the housing space 32.

The discharge groove portion 57 is located between the housing space 32 and the discharge port 53. A circular communication port 59 is provided in a bottom portion 57*a* of the discharge groove portion 57. The communication port 59 is a port through which oil within the housing space 32 is introduced to the discharge port 53. The communication port 59 communicates with the discharge hole 34 of the fitting groove portion 35 of the first case member 30. The diameter of the discharge hole 34 is equal to or smaller than that of the communication port 59. The discharge groove portion 57 forms a part of the discharge passage 55 that connects the housing space 32 to the discharge port 53.

The fitting groove portion 35 of the first case member 30 is fitted to the discharge groove portion 57. The fitting groove portion 35 is formed in a shape corresponding to the discharge groove portion 57, and is fitted to the discharge groove portion 57 so as to cover the surface of the discharge groove portion 57. The surface of the discharge groove portion 57 is not exposed to oil that flows from the housing space 32 side (that is, the opening of the discharge groove portion 57) to the communication port 59 of the bottom portion 57*a*, and the discharge groove portion 57 does not directly receive the oil pressure of the oil flowing through the discharge passage 55.

As shown in FIG. 5, the cover member 60 is disposed so as to be adjacent to the housing body member 50 in the axial direction at the opening side at which the case holding portion 51 is formed. The cover member 60 is fixed to the housing body member 50, thereby bringing the second case member 40 into close contact with the first case member 30 and forming the housing case in which the trochoid is housed. The cover member 60 is a member formed in a disc shape or an annular shape.

Figure 13:
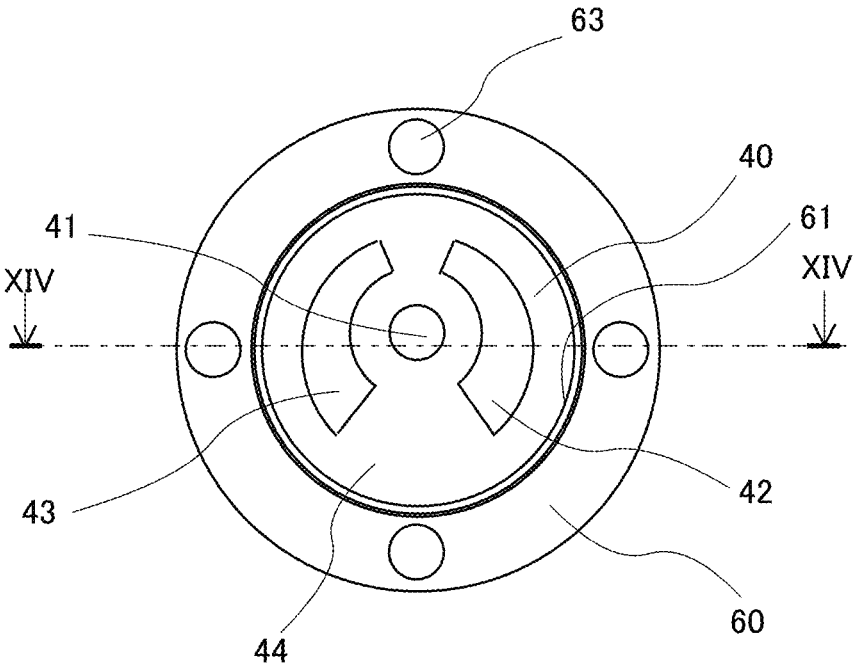
FIG. 13 is a front view of an assembly obtained by assembling the second case member to a cover member of a housing included in the oil pump according to the embodiment, as seen from the housing space side.
Figure 14:
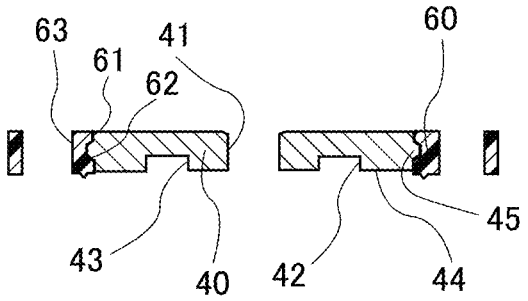
FIG. 14 is a cross-sectional view of the assembly obtained by assembling the second case member to the cover member of the housing of the embodiment, taken along a line XIV-XIV shown in FIG. 13.

The cover member 60 has a holding hole 61 and a holding groove 62. The holding hole 61 is a through hole that penetrates a body of the cover member 60 in the axial direction. The holding hole 61 is formed in a size corresponding to the outer shape of the second case member 40, and has an inner diameter equal to the outer diameter of the second case member 40. As shown in FIG. 13 and FIG. 14, the second case member 40 is inserted into the holding hole 61. The holding groove 62 is provided on the periphery of the holding hole 61 and formed in an annular shape. The holding groove 62 is a groove portion that is recessed outward in the radial direction. A projection 45 is formed in an annular shape on the outer peripheral side surface of the second case member 40 so as to project radially outward.

The second case member 40 is held in a state of being inserted in the holding hole 61 of the cover member 60, by fitting the projection 45 into the holding groove 62 of the cover member 60.

The cover member 60 has a through hole 63. The through hole 63 penetrates a portion located radially outward of the holding hole 61, in the axial direction. The through hole 63 is provided at a plurality of locations (for example, four locations) over the circumferential direction. In addition, the housing body member 50 has a bolt hole 50*a*. The bolt hole 50*a* extends in the axial direction in a portion located radially outward of the case holding portion 51. The bolt hole 50*a* is provided at a plurality of locations (for example, four locations) around the case holding portion 51.

The through holes 63 and the bolt holes 50*a*, the numbers of which are equal to each other, are provided at positions corresponding to each other. The cover member 60 is fixed to the housing body member 50 by fastening bolts 70 to nuts (not shown) through collars 71 disposed in the through holes 63 of the cover member 60 and collars 72 disposed in the bolt holes 50*a* of the housing body member 50. In FIG. 5, etc., the collars 71 and 72 are not shown.

When the cover member 60 is fixed to the housing body member 50 using the bolts 70, an axial end surface of the first case member 30 held in the case holding portion 51 of the housing body member 50 and an axial end surface of the second case member 40 held in the holding hole 61 of the cover member 60 are in contact with each other in the axial direction, and an axial end surface of the housing body member 50 and an axial end surface of the cover member 60 oppose each other in the axial direction.

The housing body member 50 and the cover member 60 have a seal structure. The seal structure is a structure in which a recess and a projection formed on the axial end surfaces of the housing body member 50 and the cover member 60 are fitted to each other. When assembling the housing body member 50 and the cover member 60, the recess and the projection, while coming into contact with each other, elastically deform to come into close contact with each other without any gap therebetween and become fitted to each other over the entire circumference in the circumferential direction around the drive shaft 2. Owing to this fitting, sealing is ensured between the housing body member 50 and the cover member 60.

A seal member 80 is disposed between the first case member 30 and the housing body member 50. The seal member 80 is formed in an annular shape so as to surround the opening of the fitting groove portion 35 of the first case member 30. Specifically, the seal member 80 is disposed between a portion, close to the fitting groove portion 35, of the bottom portion 31*a* of the rotor housing portion 31 of the first case member 30 and the bottom portion 51*a* of the case holding portion 51 of the housing body member 50. The seal member 80 is formed from a synthetic rubber or a resin.

The seal member 80 is brought into close contact with the first case member 30 and the housing body member 50 without any gap therebetween by assembling the housing body member 50 and the cover member 60. Thus, sealing is ensured between the first case member 30 and the housing body member 50 around the fitting groove portion 35. That is, the discharge groove portion 57, the internal pressure of which becomes high, and the suction groove portion 56, the internal pressure of which is low, are maintained in a state of being separated from each other, by the seal member 80.

The seal member 80 only has to be disposed between the housing body member 50 and a portion of the first case member 30 where the bottom portion 31*a* of the rotor housing portion 31 and the side portion of the fitting groove portion 35 are connected to each other, or the vicinity of this portion. For example, the seal member 80 may be disposed between the side portion of the discharge groove portion 57 of the housing body member 50 and a portion, close to the rotor housing portion 31, of the side portion of the fitting groove portion 35 of the first case member 30.

In the above oil pump 1, when the drive shaft 2 rotates, the inner rotor 10 of the trochoid rotates relative to the outer rotor 20 in the housing space 32 of the housing case formed by the first case member 30 and the second case member 40. During the rotation of the trochoid, when the volume of the housing space 32 increases, the internal pressure of the housing space 32 becomes negative. When the internal pressure of the housing space 32 becomes negative, oil is sucked from the suction port 52 of the housing body member 50 through the suction passage 54 into the housing space 32 of the first case member 30. Thereafter, when the volume of the housing space 32 is decreased by the rotation of the trochoid, the oil pressure within the housing space 32 rises. When the oil pressure rises, the oil within the housing space 32 is introduced through the discharge passage 55 of the housing body member 50 to the discharge port 53 and discharged to the outside. When this pumping action is continuously performed by the rotation of the trochoid, the oil is pressure-fed from the oil pump 1.

In the above oil pump 1, the housing body member 50 has the case holding portion 51 in which the first case member 30 is housed and held, and is also formed from a resin. The discharge groove portion 57 is provided on the housing body member 50, as an oil reservoir that forms a part of the discharge passage 55. In addition, the first case member 30 has the rotor housing portion 31 in which the trochoid is housed, and is also formed from a metal. The fitting groove portion 35, which is fitted to the above discharge groove portion 57, is provided to the first case member 30. The fitting groove portion 35 is formed in a shape corresponding to the discharge groove portion 57, and is fitted to the discharge groove portion 57 so as to cover the surface of the discharge groove portion 57.

In this structure, the surface of the discharge groove portion 57 is not exposed to oil that flows from the opening of the discharge groove portion 57 to the communication port 59 of the bottom portion 57*a*, and the discharge groove portion 57 does not directly receive the oil pressure of the oil. That is, when oil is pressure-fed, the oil within the housing space 32 flows from the housing space 32 of the first case member 30 via the fitting groove portion 35 to the discharge hole 34 of the bottom portion 35*a*, then flows from the communication port 59 of the bottom portion 57*a* of the discharge groove portion 57 of the housing body member 50 through the discharge passage 55 to the discharge port 53, and is discharged to the outside. At this time, the pressure of the oil that has flowed from the housing space 32 of the first case member 30 into the fitting groove portion 35 is high, but the oil pressure does not directly act on the discharge groove portion 57 of the housing body member 50 and acts on the surface of the fitting groove portion 35.

As described above, the first case member 30 is formed from a metal, and the housing body member 50 is formed from a resin. Therefore, when oil is pressure-fed, high oil pressure acts on the first case member 30 made of a metal, but a metallic member is harder to deform due to external pressure than a resin member, and thus a situation in which the above high oil pressure within the fitting groove portion 35 acts on the housing body member 50 made of a resin is avoided. Thus, the housing body member 50 made of a resin is prevented from becoming easy to deform when oil is pressure-fed, thereby inhibiting deformation of the housing body member 50.

In particular, the discharge hole 34 of the fitting groove portion 35 of the first case member 30 and the communication port 59 of the discharge groove portion 57 of the housing body member 50 communicate with each other, and the diameter of the discharge hole 34 is equal to or smaller than that of the communication port 59. Thus, the surface of the discharge groove portion 57 has no portion exposed to oil, and the discharge groove portion 57 has no portion on which high oil pressure directly acts. Therefore, the housing body member 50 made of a resin is reliably prevented from becoming easy to deform when oil is pressure-fed, thereby reliably inhibiting deformation of the housing body member 50.

In the structure of the above oil pump 1, resin is used as the material of the housing formed by the housing body member 50 and the cover member 60. In addition, to ensure a stable pressure-feeding amount and accuracy in assembling of the oil pump 1, high shape accuracy is required for the second case member 40 and the first case member 30 in which the inner rotor 10 and the outer rotor 20 are housed, and the first case member 30 and the second case member 40 are formed from a metal. Furthermore, high strength is required for a portion on which high-pressure oil acts, and this portion is limited to the first case member 30 and the second case member 40 made of a metal. Therefore, easier production and size reduction of the oil pump 1 are achieved while weight reduction of the oil pump 1 is achieved, and required accuracy of the first case member 30 and the second case member 40 is easily ensured.

Furthermore, in the oil pump 1, the seal member 80 is disposed between the first case member 30 and the housing body member 50. The seal member 80 is disposed between the housing body member 50 (the bottom portion 51*a* of the case holding portion 51 in FIG. 5 and FIG. 11) and the portion of the first case member 30 where the bottom portion 31*a* of the rotor housing portion 31 and the side portion of the fitting groove portion 35 are connected to each other, or the vicinity of this portion (the bottom portion 31*a* in FIG. 5 and FIG. 11).

With this structure, sealing is ensured between the first case member 30 and the housing body member 50 around the fitting groove portion 35. Thus, oil within the fitting groove portion 35 is inhibited from leaking to the suction passage 54 side through the gap between the first case member 30, in which the trochoid formed by the inner rotor 10 and the outer rotor 20 is housed, and the housing body member 50, in which the first case member 30 is held, and oil within the suction passage 54 is inhibited from leaking to the discharge passage 55 side through the gap between the first case member 30 and the housing body member 50. Accordingly, oil to be pressure-fed is ensured to have desired oil pressure.

In the above embodiment, the inner rotor 10 corresponds to "rotor" described in the claims, the first case member 30 corresponds to "housing case" described in the claims, and the housing body member 50 corresponds to "housing" described in the claims.

Meanwhile, in the above embodiment, the discharge hole 34 of the first case member 30 is formed in the bottom portion 35*a* of the fitting groove portion 35. However, the present invention is not limited thereto, and may be applied to an oil pump 1 in which the discharge hole 34 of the first case member 30 is formed in the side portion 35*b* of the fitting groove portion 35.

Figure 15:
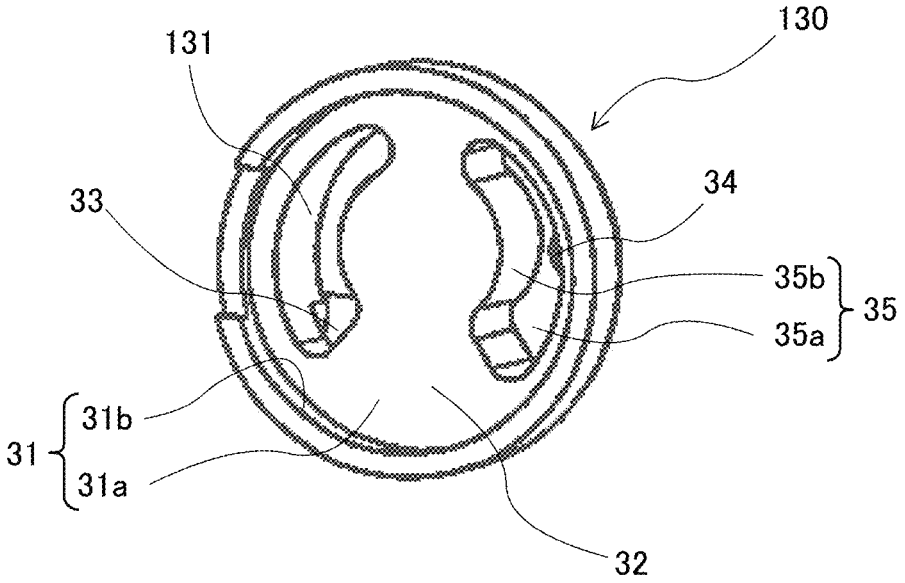
FIG. 15 is a perspective view of a first case member of a housing case included in an oil pump according to a modification, as seen from the housing space side.
Figure 16:
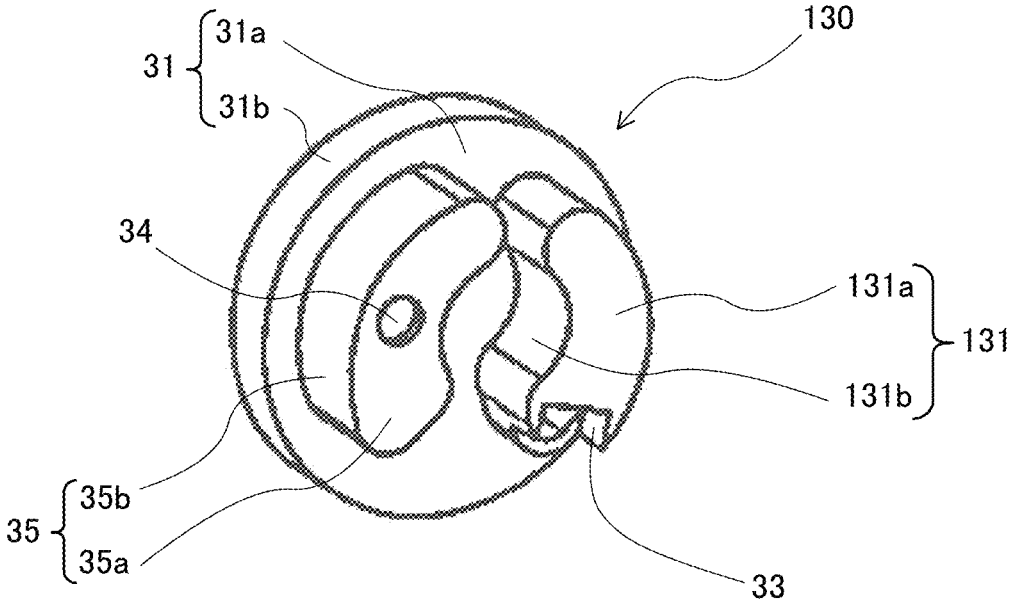
FIG. 16 is a perspective view of the first case member of the housing case included in the oil pump according to the modification, as seen from an anti-housing space side.

In the above embodiment, the first case member 30 has the fitting groove portion 35 that is fitted to the discharge groove portion 57 provided on the housing body member 50, but does not have a groove portion that is fitted to the suction groove portion 56 provided on the housing body member 50. However, the present invention is not limited thereto, and, as shown in FIG. 15 and FIG. 16, a first case member 130 may have the fitting groove portion 35 and also have a fitting groove portion 131 that is fitted to the suction groove portion 56 provided on the housing body member 50.

In this modification, the fitting groove portion 131 is provided on the bottom portion 31*a* of the rotor housing portion 31. The fitting groove portion 131 extends in an arc shape in the circumferential direction on the bottom portion 31*a*. The fitting groove portion 131 has a depth in the axial direction opposite to the axial direction in which the side portion 31*b* projects from the surface of the bottom portion 31*a*. The fitting groove portion 131 has a bottom portion 131*a*, and a tubular side portion 131*b* that projects from the outer edge of the bottom portion 131*a* in the axial direction. The fitting groove portion 131 is provided on a portion different from the portion on which the fitting groove portion 35 at the discharge side is provided. That is, the fitting groove portion 35 and the fitting groove portion 131 are not directly connected to each other on the bottom portion 31*a* of the first case member 30. The fitting groove portion 131 is a groove that is fitted to the suction groove portion 56 of the housing body member 50. The introduction hole 33 of the first case member 30 is formed in the bottom portion 131*a* or the side portion 131*b* of the fitting groove portion 131.

The present invention is not limited to the embodiments and modifications described above, and various changes may be made without departing from the gist of the present invention.

This application claims priority on Japanese Patent Application No. 2019-059504 filed in Japan on Mar. 26, 2019, the entire contents of which are incorporated herein by reference.

The invention claimed is:

1. An oil pump comprising:

a first case member made of a metal and having a rotor housing portion in which a rotor is rotatably housed, and a discharge hole through which oil within the rotor housing portion is introduced to the outside of the rotor housing portion by rotation of the rotor;

a second case member made of a metal and provided axially outside of and adjacent to an opening which is provided in the first case member at a side of the first case member opposite to the discharge hole in an axial direction for closing a housing space formed in the rotor housing portion; and a housing made of a resin and having a case holding portion in which the rotor housing portion is held, and a discharge groove portion provided on a bottom portion of the case holding portion, wherein the first case member has a fitting groove portion that is provided on a bottom portion of the rotor housing portion and that is fitted to the discharge groove portion so as to cover the discharge groove portion, the second case member has a communication groove provided at a position opposing the fitting groove portion in an axial direction and that communicates with the housing space and the fitting groove portion includes a bottom portion extending from the discharge hole in a radial direction, and a side portion surrounding an entire periphery of the bottom portion of the fitting groove portion, the side portion projecting from the bottom portion of the rotor housing portion in the axial direction, the discharge hole is formed in the bottom portion of the fitting groove portion so that, on a surface of the bottom portion opposite to the communication port, a wall body extending in the radial direction is continuous with an entire circumference of the discharge hole from an entirety of a circumferential edge of the discharge hole to an entirety of the side portion of the fitting groove portion, wherein the housing has a communication port that is formed in the discharge groove portion and that communicates with the discharge hole, the fitting groove portion is formed such that the discharge hole has a diameter equal to or smaller than that of the communication port, the fitting groove portion is formed to be a shape corresponding to the discharge groove portion, the bottom portion of the fitting groove portion opposes a bottom portion of the discharge groove portion and is directly connected thereto and the side portion of the fitting groove portion opposes a side portion of the discharge groove portion and is directly connected thereto, and the fitting groove portion is disposed so that the discharge hole is fitted adjacent to the communication port.

2. The oil pump according to claim 1, further comprising a seal member that is disposed between a portion of the first case member where the rotor housing portion and the fitting groove portion are connected to each other, and the housing and that seals the first case member and the housing.

* * * * *